US006882255B2

(12) United States Patent
Mueller-Fiedler et al.

(10) Patent No.: US 6,882,255 B2
(45) Date of Patent: Apr. 19, 2005

(54) DEVICE HAVING A CAPACITOR WITH ALTERABLE CAPACITANCE, IN PARTICULAR A HIGH-FREQUENCY MICROSWITCH

(75) Inventors: Roland Mueller-Fiedler, Leonberg (DE); Thomas Walter, Renningen (DE); Markus Ulm, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 147 days.

(21) Appl. No.: 10/220,683

(22) PCT Filed: Dec. 13, 2001

(86) PCT No.: PCT/DE01/04693

§ 371 (c)(1),
(2), (4) Date: Dec. 6, 2002

(87) PCT Pub. No.: WO02/054528

PCT Pub. Date: Jul. 11, 2002

(65) Prior Publication Data

US 2003/0146804 A1 Aug. 7, 2003

(30) Foreign Application Priority Data

Jan. 4, 2001 (DE) ..... 101 00 296

(51) Int. Cl.[7] ..... H01P 1/10
(52) U.S. Cl. ..... 333/262; 333/33; 200/181
(58) Field of Search ..... 333/262, 33; 200/181

(56) References Cited

U.S. PATENT DOCUMENTS

| | | | | |
|---|---|---|---|---|
| 5,619,061 A | | 4/1997 | Goldsmith et al. | 257/528 |
| 6,016,092 A | | 1/2000 | Qiu et al. | 333/262 |
| 6,100,477 A | * | 8/2000 | Randall et al. | 200/181 |
| 6,404,304 B1 | * | 6/2002 | Kwon et al. | 333/202 |
| 6,606,017 B1 | * | 8/2003 | Xu et al. | 333/205 |

FOREIGN PATENT DOCUMENTS

| | | |
|---|---|---|
| DE | 100 37 385 | 2/2002 |

OTHER PUBLICATIONS

Barker et al., Distributed MEMS Tru–Time Delay Phase Shifters and Wide–Band Switches, 11/98, IEEE Transactions on Microwave Theory and techniques, vol. 46, No. 11, pp. 1881–1890.*

Ulm et al., *Microelectromechanical Capacitive RF Switches on High* Resistivity Silicon Substrates, Proceedings of International Conference on Microtechnologies, Sep. 25, 2000, pp. 93–96.

Park et al., *Elecrtroplated RF Means Capacitive Switches*, Proceedings IEEE Thirteenth Annual International Conference on Micro Electro Mechanical Systems, Jan. 2000, pp. 639–644.

* cited by examiner

*Primary Examiner*—Stephen E. Jones
(74) *Attorney, Agent, or Firm*—Kenyon & Kenyon

(57) ABSTRACT

A capacitor with alterable capacitance for changing the impedance of a section of a coplanar waveguide, which may be used in particular as a high-frequency microswitch, is provided. A ground lead and a signal lead interrupted by an electroconductive connection which is self-supporting at least in some areas are provided, the capacitor including the electroconductive connection and an additional electroconductive connection connected to the ground lead. A structure connected to the electroconductive connection is provided, which is designed in such a manner that it reduces mechanical stresses which occurs in the electroconductive connection. An exemplary embodiment of the device provides for the electroconductive connection to be made of a material having coefficients of thermal expansion similar to that of silicon and a high modulus of elasticity compared to metals, in particular of molybdenum, tantalum or tungsten. The two exemplary embodiments may be combined.

17 Claims, 2 Drawing Sheets

DEVICE HAVING A CAPACITOR WITH ALTERABLE CAPACITANCE, IN PARTICULAR A HIGH-FREQUENCY MICROSWITCH

FIELD OF THE INVENTION

The present invention relates to a device, in particular one manufactured using micromechanics, having a capacitor with alterable capacitance for changing the impedance of a coplanar waveguide.

BACKGROUND INFORMATION

In German Published Patent Application No. 100 37 385, a micromechanically manufactured high-frequency switch is described having a thin metal bridge which is inserted into the signal lead of a coplanar waveguide at a predefined length and interrupts it there. It was also proposed there that an electroconductive connection be provided beneath the metal bridge between two ground leads of the coplanar waveguide which are routed parallel to the signal lead, the surface of the connection beneath the bridge having a dielectric layer. The metal bridge thus forms, together with the electroconductive connection, a capacitor with which the impedance of the relevant section of the coplanar waveguide is alterable. When the high-frequency switch is operated, the bridge may then be drawn onto the dielectric layer, electrostatically or by applying an appropriate voltage to the capacitor, causing the capacitance of the plate capacitor made up of the bridge and the electroconductive connection to increase, which affects the propagation properties of the electromagnetic waves carried on the waveguide. In particular, in the "off" state, i.e., the metal bridge is down, a large part of the power is reflected, whereas in the "on" state, i.e., the metal bridge is up, a large part of the power is transmitted.

SUMMARY OF THE INVENTION

The device according to an exemplary embodiment of the present invention having a capacitor with alterable capacitance may have the advantage that temperature changes which arise during operation of the device may not result in temperature-dependent electromechanical properties of this device.

The provision of an additional structure—possibly U-shaped—and the use of this structure for suspending the second connection on at least one side may make it possible to equalize "in-plane" stresses; that is, this structure may have the advantageous effect that intrinsic and/or thermally induced stresses in the bridge formed by the second connection may be eliminated. It may also be advantageous that the restoring force in the event of an "out-of-plane" deflection of this bridge, i.e., a second connection of bending moments, is analogous to a thin bar clamped at one side, and that the "out-of-plane" flexural rigidity of the incorporated structure may be negligible.

In addition it may also be advantageous that the flexural rigidity of the bridge formed by the second connection is only slightly temperature-dependent over the temperature coefficient of the modulus of elasticity of the material of the bridge.

Since silicon is often used as a substrate material, which may have a lower coefficient of thermal expansion than most other metals which are used to implement the second connection because of their electrical conductivity, in micromechanics, the use of molybdenum, tungsten, or tantalum as the material for the second electroconductive connection may be advantageous.

The use of molybdenum may be advantageous, since it possesses a coefficient of thermal expansion of $4*10^{-6}$ per kelvin, which is similar to that of silicon at $2.7*10^{-6}$ kelvin, and since it exhibits a modulus of elasticity which at 340 GPa is relatively high compared to that of other metals, for example aluminum at 70 GPa.

When molybdenum, tantalum, or tungsten is used, temperature changes may not result in a build-up of stresses in the second connection, or only on a lower scale, so that such temperature changes no longer cause unwanted impairment of the switching voltage and the switching times which occur in the device. In addition, the reduction achieved in these stresses also influences the forces which occur to move the second connection when switching, in particular restoring forces.

The high modulus of elasticity of molybdenum, tantalum or tungsten may also have the advantage that the bridge formed by the second connection has sufficient flexural rigidity.

Thus, it may be advantageous when molybdenum, tantalum, or tungsten is used as the material for the second connection and at the same time as the material for the inserted structure.

Providing the additional structure may have the further advantage that additional inductance is incorporated into the equivalent circuit diagram of the device according to an exemplary embodiment of the present invention by giving it a calculated shape and dimension, through which the insertion loss of this device may be reduced.

DETAILED DESCRIPTION

Figure 1:
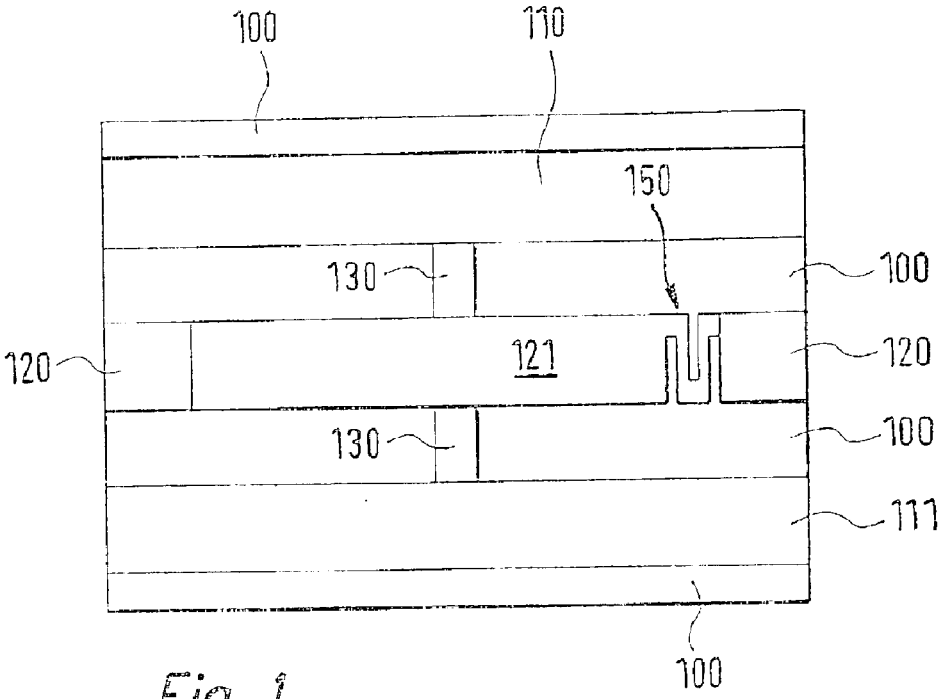
FIG. 1 shows a top view of a device according to an exemplary embodiment of the present invention.

FIG. 1 shows, as an exemplary embodiment, a micromechanically manufactured high-frequency short-circuit switch. An insulating layer 100 having a small loss angle, made for example of silicon dioxide having a thickness of 100 nm to 3 $\mu$m, is provided on a supporting body 90 of high-impedance silicon having a thickness for example of 100 $\mu$m to 500 $\mu$m. A coplanar waveguide which has three coplanar electroconductive conductors which are routed, at least locally, approximately parallel to each other is placed on insulating layer 100. The conductors of the coplanar waveguide are possibly made of metal and produced on the insulating layer 100 initially for example by sputtering on an initial metallization and via one or more subsequent galvanic process steps. The outer two of the three conductors of the coplanar waveguide correspond to a first ground lead 110 and a second ground lead 111, while the middle conductor corresponds to a signal lead 120 of the coplanar waveguide. FIG. 1 shows the section of such a coplanar waveguide routed on the insulating layer 100 which is of interest for the device according to an exemplary embodiment of the present invention.

The two ground leads 110, 111 of the coplanar waveguide are linked by a first electroconductive connection 130, made for example of a metal, which is applied in some areas of the surface of insulating layer 100 and which has little "height" in comparison with the "height" of ground leads 110, 111. In this respect, first connection 130 links ground leads 110, 111 at their "feet" on insulating layer 100 in the form of a short-circuiting link. In the area of first connection 130, signal lead 120 of the coplanar waveguide is also interrupted; that is, first connection 130 is not electroconductively connected to signal lead 120. In addition, a dielectric layer 140 which is not visible in FIG. 1 is applied to first connection 130 in the area of the interruption.

FIG. 1 also shows that interrupted signal lead 120 is provided with a second electroconductive connection 121 which is inserted between the ends of interrupted signal lead 120 in the form of a metal connecting bridge or signal bridge, and which runs at a certain clearance from the plane of insulating layer 100 and initially parallel thereto. The clearance from second connection 121 to insulating layer 100, i.e., to first connection 130, corresponds approximately to the height of signal lead 120. As a result, when no forces are present on second connection 121, second connection 121 "floats" between the ends of interrupted signal lead 120, and may be at least largely self-supporting.

Second connection 121 is possibly made of molybdenum. However, other electroconductive materials having a coefficient of thermal expansion similar to that of silicon and a high modulus of elasticity compared to common metals, such as aluminum, are also suitable. Typical dimensions of second connection 121 are between 20 $\mu$m×150 $\mu$m and 100 $\mu$m×600 $\mu$m, with a thickness of 0.5 $\mu$m to 1.5 $\mu$m.

Shown in FIG. 1 between second connection 121, which is possibly designed in the form of a flat strip, and signal line 120, is a structure, which is connected to both second connection 121 and signal line 120, and which is designed as a U-shaped or meander-shaped spring running flat in the plane of the strip of second connection 121. This structure 150 may cause a reduction in mechanical stresses which may occur in second connection 121, and which may occur in particular under temperature fluctuations or which also may be intrinsically present.

According to FIG. 1, structure 150 also functions, at least on one side, as mounting and connection of self-supporting, electroconductive second connection 121 to an assigned section of signal lead 120. Structure 150 may be provided for that purpose at one end as shown, or alternatively at both ends of second connection 121. In addition, it is also possible to insert structure 150 in some areas, for example centrally, in second connection 121.

Second connection 121 and structure 150 may be designed as a single piece; i.e., structure 150 may be a structured part of second connection 121.

Figure 2:
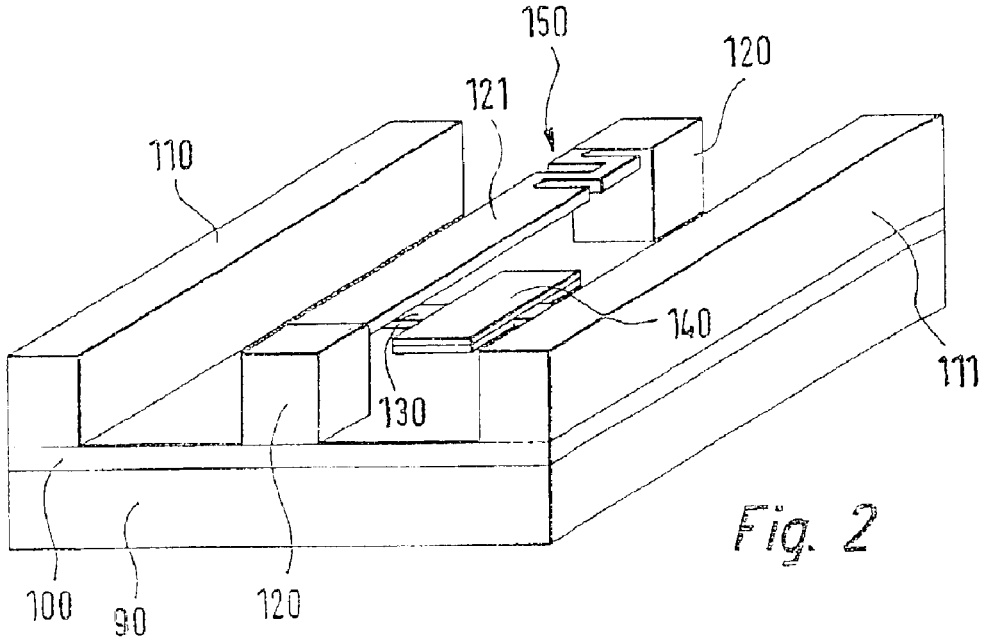
FIG. 2 shows a perspective view of FIG. 1.

FIG. 2 shows the section of the device in FIG. 1 according to an exemplary embodiment of the present invention in perspective. Dielectric layer 140 and first connection 130, which runs beneath dielectric layer 140 and electroconductively connects first ground lead 110 and second ground lead 111, are also visible in FIG. 2.

Figure 3:
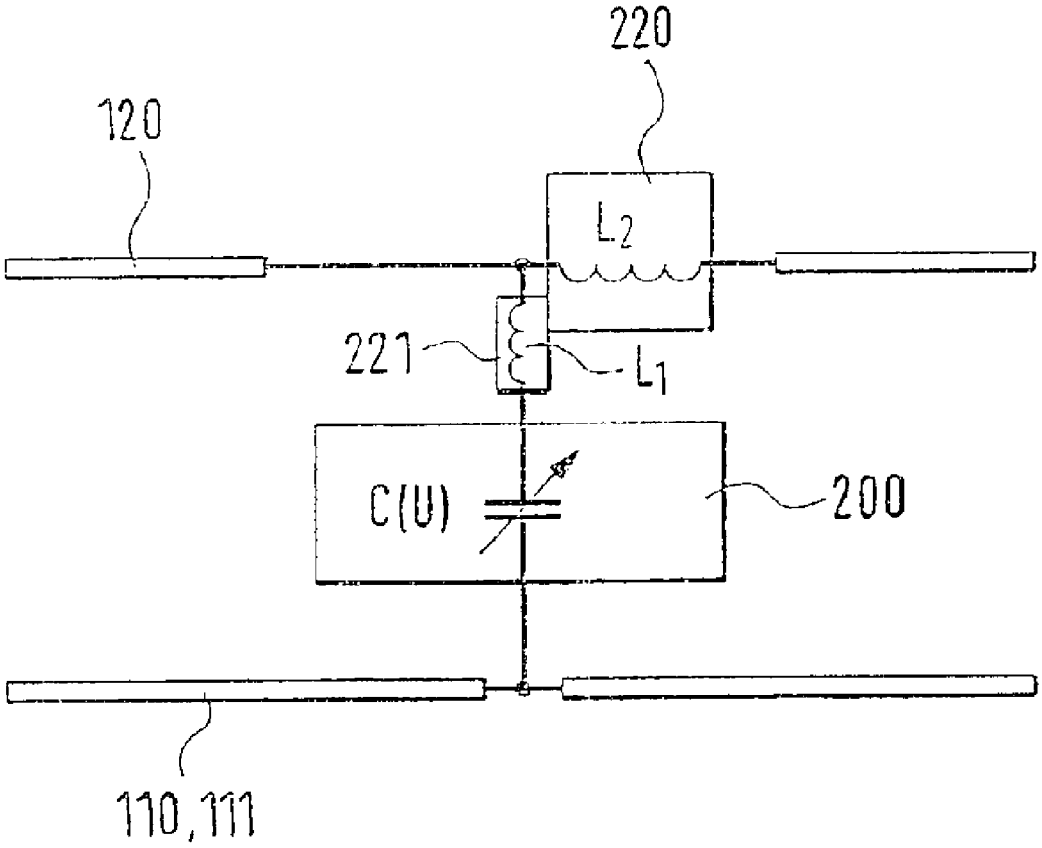
FIG. 3 shows an equivalent circuit diagram of the device according to an exemplary embodiment of the present invention.

FIG. 3 shows an equivalent circuit diagram of the device according to an exemplary embodiment of the present invention, with the two ground leads 110, 111 shown merely in the form of a single conductor of the coplanar waveguide, since they are at the same potential. In addition, signal lead 120 of the coplanar waveguide is shown in FIG. 3. A capacitor 200 (C(U)) is positioned between signal lead 120 and ground leads 110, 111. In addition, at this point a first inductance 221 ($L_1$) is present, which is implemented in FIGS. 1 and 2 approximately by first connection 130.

This first inductance 221 ($L_1$) may be defined by a structuring of first connection 130, which acts as a DC voltage short circuit between ground leads 110, 111. At the same time it may be determined by a local variation of the length to width ratio of first connection 130 or its shape, for example a meander shape or other similar shape.

Capacitor 200 in FIG. 3 is implemented at least partially by first connection 130 and second connection 121. The capacitance of capacitor 200 is alterable by second connection 121 becoming mechanically deformed when an appropriate voltage, for example a DC voltage U, is applied between signal lead 120 and ground leads 110, 111, so that a clearance changes between second connection 121 and first connection 130 at least in some areas. When second connection 121 is in its non-deformed state, i.e., when no DC voltage U is applied or in the "on" state, capacitor 200 exhibits a capacitance $C_{on}$. When there is an associated deflection of the second connection from the rest position in the direction of dielectric layer 140, i.e., when DC voltage U is applied or in the "off" state, capacitor 200 exhibits a capacitance $C_{off}$.

Structure 150 in the form of a U-shaped spring may continue to act likewise through the associated current path confinement and current path extension as second inductance 220 ($L_2$) connected in series, which may cause additional reflections, possibly at high frequencies. In the equivalent circuit diagram according to FIG. 3, second inductance 220 produces a reduction in the insertion loss of the device, which may be determined by the reflection at capacitance $C_{on}$. In this respect this capacitance $C_{on}$ may be able to be equalized by the inductance $L_2$, which in turn is given or may be set easily through appropriate dimensioning and structuring of structure 150. Inductance $L_2$ may possibly be set so that at the particular operating frequency this formula applies for impedance $Z_L$ of signal lead 120:

$$Z_L = \sqrt{\frac{L_2}{C_{on}}}$$

In addition, through appropriate dimensioning and shaping of the DC voltage short circuit, i.e., first connection 130, first inductance 221 ($L_1$) which is arranged in series with formed plate capacitor 200 may be adjusted to the particular operating frequency of the device according to an exemplary embodiment of the present invention such that a series resonant circuit results. The series resonant circuit may have a resonant frequency $v_{res}$, when second connection 121 is switched off, which is near the operating frequency of the device:

$$v_{res} = \frac{1}{2\pi}\sqrt{L_1 C_{off}}$$

In the "on" state, that is, in the state in which second connection or bridge 121 is up with a relatively large clearance from insulating layer 100, the device may then be operated, due to the reduced capacitance of plate capacitor 200, outside of this resonant frequency in such a manner that a higher insertion loss does not result. Incidentally, the operating frequencies of the explained device for applications in the field of ACC (adaptive cruise control) or SRR (short range radar) may be 77 GHz or 24 GHz.

FIGS. 1 and 2 show mechanically deformable second connection 121, for the event that the depicted section of the coplanar waveguide has a high coefficient of transmission and a low coefficient of reflection. The clearance of first connection 130 and second connection 121, which along with dielectric layer 140 definitively determines the capacitance C(U) of capacitor 200, is at a maximum in FIG. 2; the clearance may be around about 2 $\mu$m to about 4 $\mu$m. In the event that a DC voltage U is applied between first connection 130 and second connection 121, an electrostatic attracting force occurs between first connection 130 and second connection 121, with the result that second connection 121 is deformed. At least in a partial area, namely approximately in the middle of the metal bridge, second connection 121 is drawn to first connection 130, i.e., to dielectric layer 140 which is applied to first connection 130. The dielectric layer may be made for instance of silicon dioxide or silicon nitride.

Regarding further details of the explained device and its functionality, reference is made to German Published Patent Application No. 100 37 385.

What is claimed is:

1. A device including a capacitor with an alterable capacitance configured to change an impedance of a section of a coplanar waveguide, comprising:

a ground lead;

an electroconductive connection which is self-supporting at least in an area;

a signal lead interrupted by the electroconductive connection; and an additional electroconductive connection connected to the ground lead;

wherein the capacitor at least partially includes the electroconductive connection and the additional electroconductive connection; and wherein the electroconductive connection includes a material, the material including a first coefficient of thermal expansion similar to a second coefficient of thermal expansion of silicon, the material including a first modulus of elasticity greater than a second modulus of elasticity of metals.

2. The device according to claim 1, further comprising:

a structure connected to the electroconductive connection, the structure configured to reduce a mechanical stress occurring in the electroconductive connection.

3. The device according to claim 1, wherein the capacitor includes a high-frequency microswitch.

4. The device according to claim 1, wherein the material includes one of molybdenum, tantalum, and tungsten.

5. A device including a capacitor with an alterable capacitance adapted to change an impedance of a section of a coplanar waveguide, comprising:

a ground lead;

an electroconductive connection which is self-supporting at least in a first area;

a signal lead interrupted by the electroconductive connection;

an additional electroconductive connection connected to the around lead; and at least one structure connected to the electroconductive connection and adapted to reduce a mechanical stress occurring in the electroconductive connection;

wherein the capacitor at least partially includes the electroconductive connection and the additional electroconductive connection; and wherein the at least one structure connects the electroconductive connection in a form of a mounting to a section of the signal lead.

6. The device according to claim 5, wherein one of:

the at least one structure is inserted in an area into the electroconductive connection; and the electroconductive connection is structured to form the at least one structure.

7. The device according to claim 6, wherein the at least one structure forms a mounting of the electroconductive connection.

8. The device according to claim 5, wherein:

the electroconductive connection is in a form of a strip; and the at least one structure includes one of a U-shaped spring and a meander-shaped spring.

9. The device according to claim 8, wherein the one of the U-shaped spring and the meander-shaped spring runs flat in a plane of the strip.

10. The device according to claim 5, wherein the at least one structure is adapted to one of reduce and suppress one of an intrinsic mechanical stress and a mechanical stress occurring due to a temperature fluctuation in the electroconductive connection.

11. The device according to claim 10, wherein the one of the intrinsic mechanical stress and the mechanical stress is directed parallel to a plane of the at least one structure.

12. The device according to claim 5, wherein an electrostatic force between the electroconductive connection and the additional electroconductive connection is configured to change the alterable capacitance of the capacitor.

13. The device according to claim 5, wherein the capacitor includes a high-frequency microswitch.

14. A device including a capacitor with an alterable capacitance adapted to change an impedance of a section of a coplanar waveguide, comprising:

a ground lead;

an electroconductive connection which is self-supporting at least in a first area;

a signal lead interrupted by the electroconductive connection;

an additional electroconductive connection connected to the ground lead; and at least one structure connected to the electroconductive connection and adapted to reduce a mechanical stress occurring in the electroconductive connection;

wherein the capacitor at least partially includes the electroconductive connection and the additional electroconductive connection; and wherein the additional electroconductive connection forms a first inductance in series with the capacitor.

15. A device including a capacitor with an alterable capacitance adapted to change an impedance of a section of a coplanar waveguide, comprising:

a ground lead;

an electroconductive connection which is self-supporting at least in a first area;

a signal lead interrupted by the electroconductive connection;

an additional electroconductive connection connected to the ground lead; and at least one structure connected to the electroconductive connection and adapted to reduce a mechanical stress occurring in the electroconductive connection;

wherein the capacitor at least partially includes the electroconductive connection and the additional electroconductive connection; and wherein at least one of the at least one structure and the electroconductive connection includes a material, the material including a first coefficient of thermal expansion similar to a second coefficient of thermal expansion of silicon, the material including a first modulus of elasticity greater than a second modulus of elasticity of metals.

16. The device according to claim 15, wherein the material includes one of molybdenum, tantalum, and tungsten.

17. A device including a capacitor with an alterable capacitance adapted to change an impedance of a section of a coplanar waveguide, comprising:

a ground lead;

an electroconductive connection which is self-supporting at least in a first area;

a signal lead interrupted by the electroconductive connection;

an additional electroconductive connection connected to the ground lead; and at least one structure connected to the electroconductive connection and adapted to reduce a mechanical stress occurring in the electroconductive connection;

wherein the capacitor at least partially includes the electroconductive connection and the additional electroconductive connection;

wherein the signal lead is interrupted at a predetermined length by the electroconductive connection and the at least one structure;

wherein the ground lead includes two ground leads which run parallel to the signal lead; and wherein the additional electroconductive connection connects the two ground leads in an additional area defined by the predetermined length.

* * * * *